US007704109B2

(12) United States Patent
Arai et al.

(10) Patent No.: US 7,704,109 B2
(45) Date of Patent: Apr. 27, 2010

(54) STRUCTURE FOR MOUNTING CABLES FOR BOAT PROPULSION UNIT

(75) Inventors: Hideto Arai, Shizuoka (JP); Hiroyuki Hasegawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 196 days.

(21) Appl. No.: 12/026,614

(22) Filed: Feb. 6, 2008

(65) Prior Publication Data

US 2008/0194159 A1 Aug. 14, 2008

(30) Foreign Application Priority Data

Feb. 9, 2007 (JP) ..... 2007-031080

(51) Int. Cl.
*B63H 20/32* (2006.01)

(52) U.S. Cl. ..... 440/76; 440/77

(58) Field of Classification Search ..... 440/76–78
See application file for complete search history.

(56) References Cited

U.S. PATENT DOCUMENTS 6,183,322 B1 2/2001 Takahashi
6,923,695 B2 8/2005 Ide et al.
7,104,856 B1 * 9/2006 Krupp et al. ..... 440/76
7,500,891 B2 * 3/2009 Yazaki ..... 440/76

FOREIGN PATENT DOCUMENTS

JP 6-45437 Y2 11/1994

* cited by examiner

*Primary Examiner*—Stephen Avila
(74) *Attorney, Agent, or Firm*—Keating & Bennett, LLP

(57) ABSTRACT

A mounting structure for cables for a boat propulsion unit that enables easy insertion of cables into a pass-through hole, as well as highly reliable water-sealing is provided in a bottom cowling of the boat propulsion unit. The cables are inserted in through-holes in a rubber grommet by opening up a slit in the rubber grommet, and then inserting the rubber grommet in a pass-through hole in the port section. The rubber grommet is fit into the pass-through hole in the pressurized condition to water-seal the pass-through hole. The pass-through hole is molded integrally with the bottom cowling. A retaining plate is wrapped around the rubber grommet to prevent the slit from opening up, and the grommet is accommodated in the pass-through hole together with the retainer plate. Then, the retainer plate is fastened to the port section by mounting bolts. Thus, the rubber grommet is fixed within the pass-through hole, and provides water-sealing by filling the gap around the cables within the pass-through hole.

20 Claims, 12 Drawing Sheets

STRUCTURE FOR MOUNTING CABLES FOR BOAT PROPULSION UNIT

BACKGROUND OF THE INVENTION

1. Field of the Invention

This invention relates to a mounting structure for the cables of a boat propulsion unit to guide the cables from the boat into an engine hood via a pass-through hole provided in the engine hood, and to provide water-sealing for the pass-through hole in a port section via a rubber grommet.

2. Description of the Related Art

This type of mounting structure for the cables of the boat propulsion unit is disclosed in JP-Y2-Hei6-45437, JP-B-3695165, and JP-A-2004-338464, for example. JP-Y2-Hei6-45437 discloses a structure in which a mounting plate and an under cover of an engine hood are separated, and a rubber grommet with cables running therethrough is sandwiched between the mounting plate and the under cover. In JP-B-3695165, a separate pass-through port is provided by connecting a port section provided in a front panel and a port section provided in a side cover. JP-A-2004-338464, FIG. 3, discloses a structure in which an engine bottom cover is divided into three pieces, split covers on the right and the left, and a cable-guide cover provided with a cylindrical portion for guiding the cables. The cables are disposed in a through hole provided in the sealing member by opening up a slit in a sealing member within the engine cover, and the sealing member is fitted into a tapered hole (pass-through hole) provided in the cylindrical portion.

However, the conventional water-sealing structure disclosed in JP-Y2-Hei6-45437 and JP-B-3695165 is not desirable because, as the port section for guiding the cables is divided, there is a possibility of water seepage from a gap at the parting line in the port section. The gap at the parting line can be water-sealed to prevent such water seepage, but it is not desirable because the complicated joint structure for water-sealing the parting line area of the engine hood will increase production cost.

In a water-sealing structure shown in FIG. 3 of JP-A-2004-338464, a port section for guiding the cables to the inside is not divided. However, the section including the port section is constructed separately from the cover element of the engine hood, and water seepage may occur at the parting line of the cover. Thus, this structure is also not desirable.

SUMMARY OF THE INVENTION

To overcome the problems described above, preferred embodiments of the present invention provide a mounting structure for the cables for a boat propulsion unit which does not include any divided parts related to the pass-through hole for guiding the cables, and at the same time, cables can be easily inserted into the pass-through hole while providing a reliable water seal.

A preferred embodiment of the present invention provides a mounting structure for cables for a boat propulsion unit, including a pass-through hole located close to the boat hull and a cover element of an engine hood covering the engine, the mounting structure for the cables of the boat propulsion unit being configured so that the cables extending from the boat hull are disposed in through-holes of a rubber grommet disposed in the pass-through hole and inserted therethrough to an inside portion in the engine hood, wherein the pass-through hole is integrally molded with the cover element, the pass-through hole includes an insertion opening and an inner cylinder wall extending from the insertion opening to the inside portion of the engine hood. The pass-through hole also includes an inner peripheral step for sealing that extends around the internal cylinder wall at a location on the inner cylinder wall. An abutted sealing section is provided on the rubber grommet that abuts the inner peripheral step for sealing when the rubber grommet is inserted from the insertion opening.

Preferably, the cables are inserted in the through-holes of the rubber grommet by opening a slit provided in the rubber grommet. A periphery of the rubber grommet includes at least an external end of the slit and is shrouded by a retainer plate. The rubber grommet is fixed by the retainer plate and pressurized toward the inside of the engine hood.

Preferably, the retainer plate includes a pair of arms extending to form a concave opening. The pair of arms wraps around the outer surface of the rubber grommet in a middle section thereof along the axis of the through-holes. The rubber grommet is arranged so that an external end of the slit is disposed between the pair of arms of the retainer plate. The rubber grommet preferably includes a slot in the middle section thereof in which the pair of arms of the retainer plate is inserted.

Preferably, the rubber grommet includes an inserting front edge and at least one protruding strip sealing area provided at a middle section of an outer surface thereof. The rubber grommet provides water-sealing by an inserting front edge of the rubber grommet being tightly in contact with the inner peripheral step, by the at least one protruding strip sealing area being tightly in contact with the internal surface of the pass-through hole.

The mounting structure preferably includes a cover member having a continuous annular shape provided at corners of the opening periphery on the inside of the cover element to which the pass-through hole is provided, in order to cover up the corners of the opening periphery.

The pass-through hole for guiding the cables is integral with the cover element. As a result, the cover element defining the engine hood for covering the engine can be easily manufactured, and no sealing is required for the pass-through hole. In addition, installation of the cables is improved because the rubber grommet can be inserted into the pass-through hole from the outside for mounting. Furthermore, the pass-through hole is effectively water-sealed by the rubber grommet, since the abutted sealing section is pressed against the step on the inner periphery for sealing.

The cables are inserted into the through-holes of the rubber grommet by opening up the slit, and then the rubber grommet is shrouded by the retainer plate before it is inserted into the pass-through hole and fastened therein in a pressurized condition. This makes it easier to insert the rubber grommet into the pass-through hole, because the retainer plate prevents the slit from opening up as the retaining plate is wrapped around the rubber grommet, and no step or gap will be present at the slit of the rubber grommet during the insertion as the rubber grommet is inserted together with the retainer plate.

The pair of arms of the retainer plate wraps around the slot of the rubber grommet to press it toward the inner portion of the pass-through hole, resulting in a firmly fixed rubber grommet. Thus, reliable water-sealing for the pass-through hole is provided by the rubber grommet, since the sealing area of the rubber grommet is pressed tightly against the sealing area of the pass-through hole.

The rubber grommet provides water-sealing at two or more places in the pass-through hole, resulting in further improved water-sealing quality.

The corners of the opening periphery on the inside of the cover element of the port section are enclosed by the cover member having a continuous annular shape. Thus, the cover member protects the cables against the sharp flashing that may be generated at the corners of the opening periphery during the molding process of the cover element. The cover member also protects the cables from the sharp edge when the cables are come in contact with the sharp edge at the corners of the opening periphery, in view of the fact that a sharp edge is inevitably created by providing the pass-through hole of the port section at a sharp angle relative to the cover element.

Other features, elements, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described with reference to the drawings.

Figure 1:
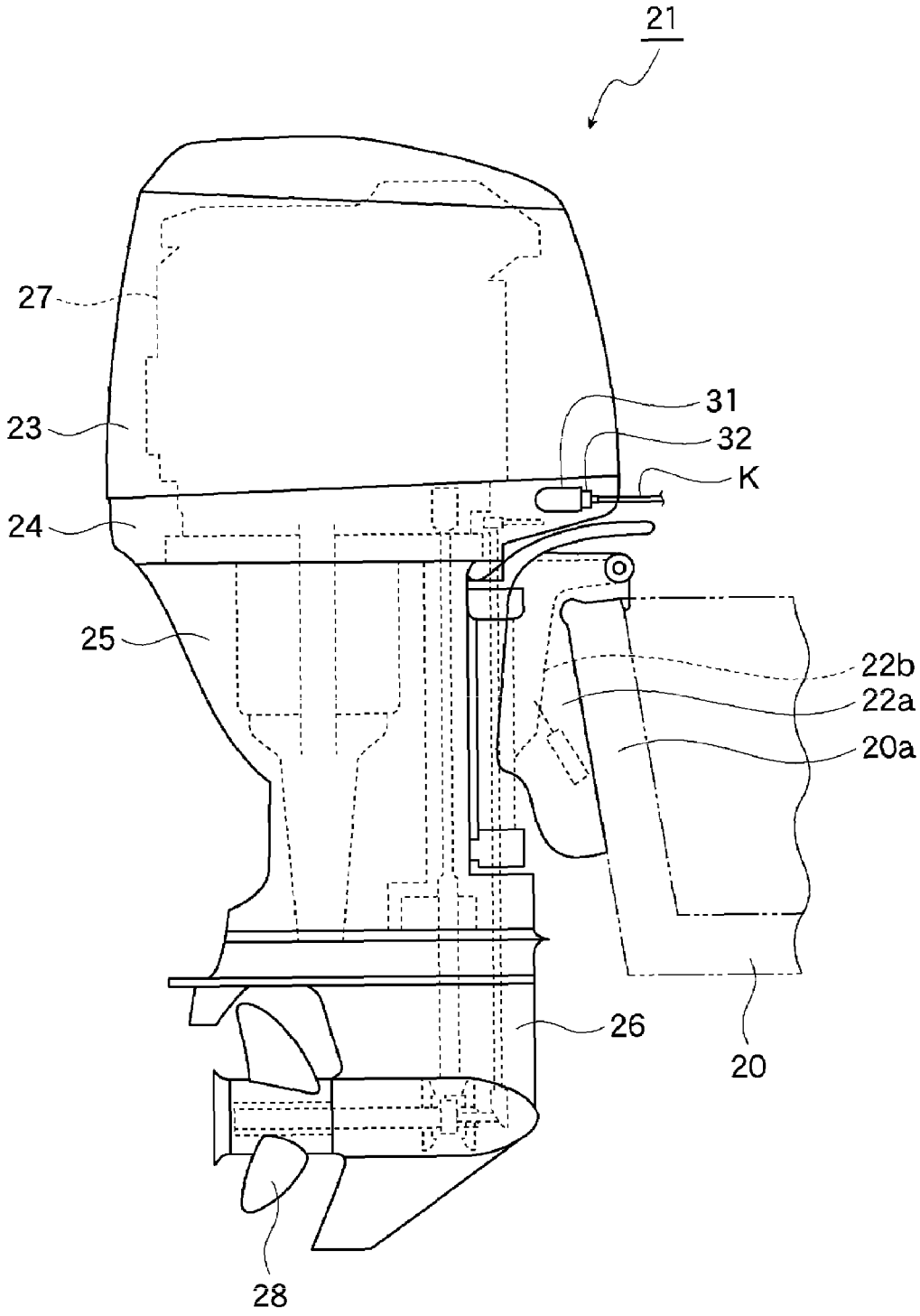
FIG. 1 is a side view of a boat propulsion unit according to a preferred embodiment of the present invention.

FIGS. 1 through 12C show a mounting structure for cables for a boat propulsion unit according to preferred embodiments of the present invention. First, the structure of a preferred embodiment will be explained. As shown in FIG. 1, a mounting plate 22*a* is fastened to a transom board 20*a* located at the stern of a boat 20. An outboard motor 21, representing a "boat propulsion unit," is mounted on the mounting plate 22*a* by a swivel bracket 22*b* so as to enable the tilt-up motion of the outboard motor 21. The mounting structure of the cables according to this preferred embodiment of the present invention is attached to a bottom cowling 24 of the outboard motor 21.

The outboard motor 21 includes a cover having separate sections joined to each other, which include a top cowling 23, the bottom cowling 24, an upper case 25, and a lower case 26. The top cowling 23 and the bottom cowling 24 are cover elements defining an engine hood for covering the engine 27. The outboard motor 21 drives a propeller 28 using the rotational output power generated by the engine 27.

As shown in FIG. 1, the mounting structure for the cables of the boat propulsion unit is configured to guide the cables K extending from the boat and entering inside of the engine hood via a pass-through hole provided in a port section 31 of the bottom cowling 24 covering the engine 27, and to provide water-sealing for the pass-through hole in the port section 31 using a rubber grommet 32. It should be noted that the cables K are not shown in the figures except for in FIGS. 1 and 6.

Figure 2:
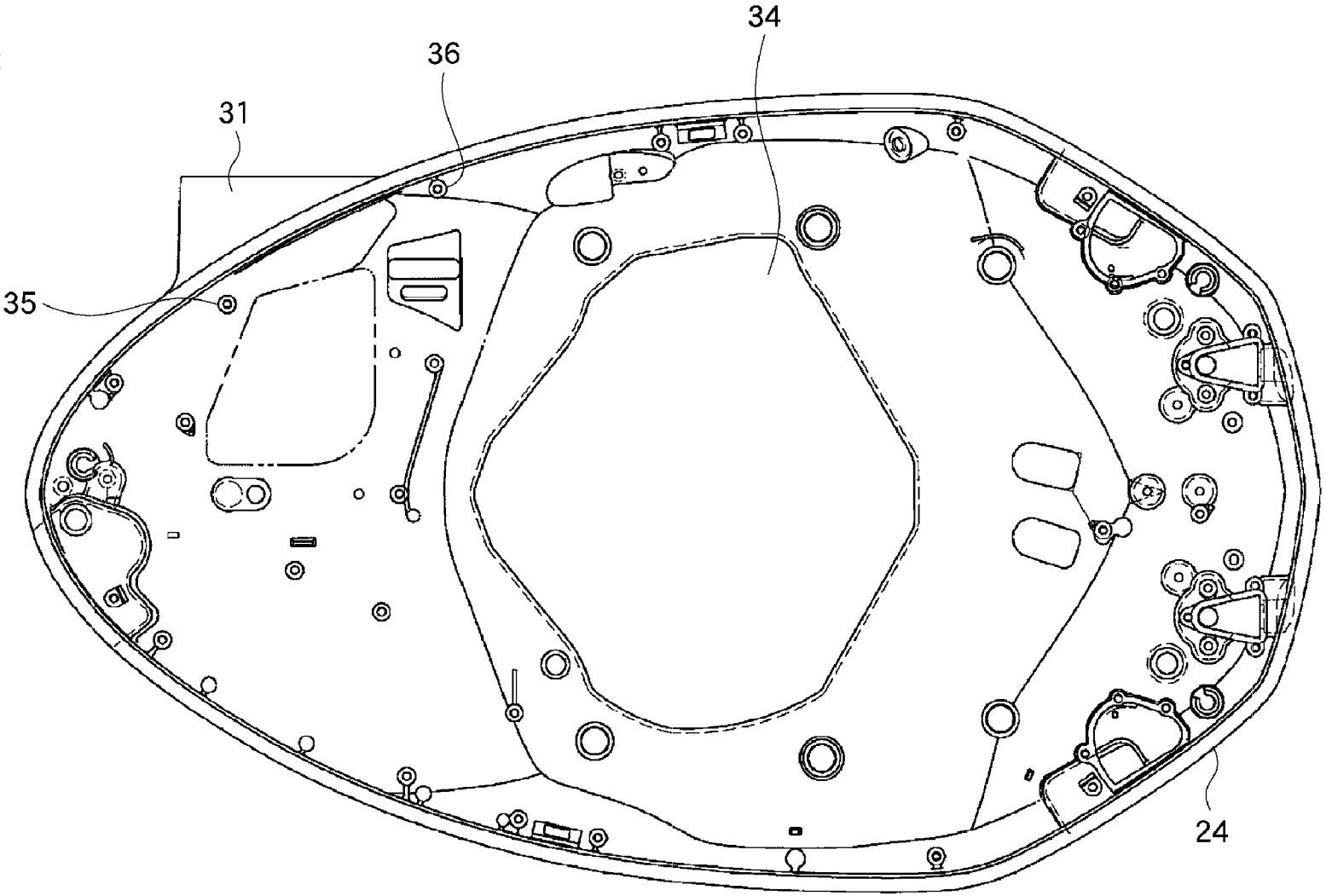
FIG. 2 is a plan view of a bottom cowling which is a cover element of the engine hood for covering the boat propulsion unit in FIG. 1.

FIG. 2 is a plan view of the bottom cowling 24. The lower portion of the bottom cowling 24 in FIG. 2 is closer to the boat hull. In this preferred embodiment, the port section 31 is preferably provided integrally on the right side close to the boat hull on the bottom cowling 24 and preferably has an approximately oval shape. Thus, since the port section 31 does not include any separate structure, there is no possibility of water seepage at the mating surface. Reference numeral 34 indicates an opening communicating with the upper casing 25 shown in FIG. 1.

Figure 3:
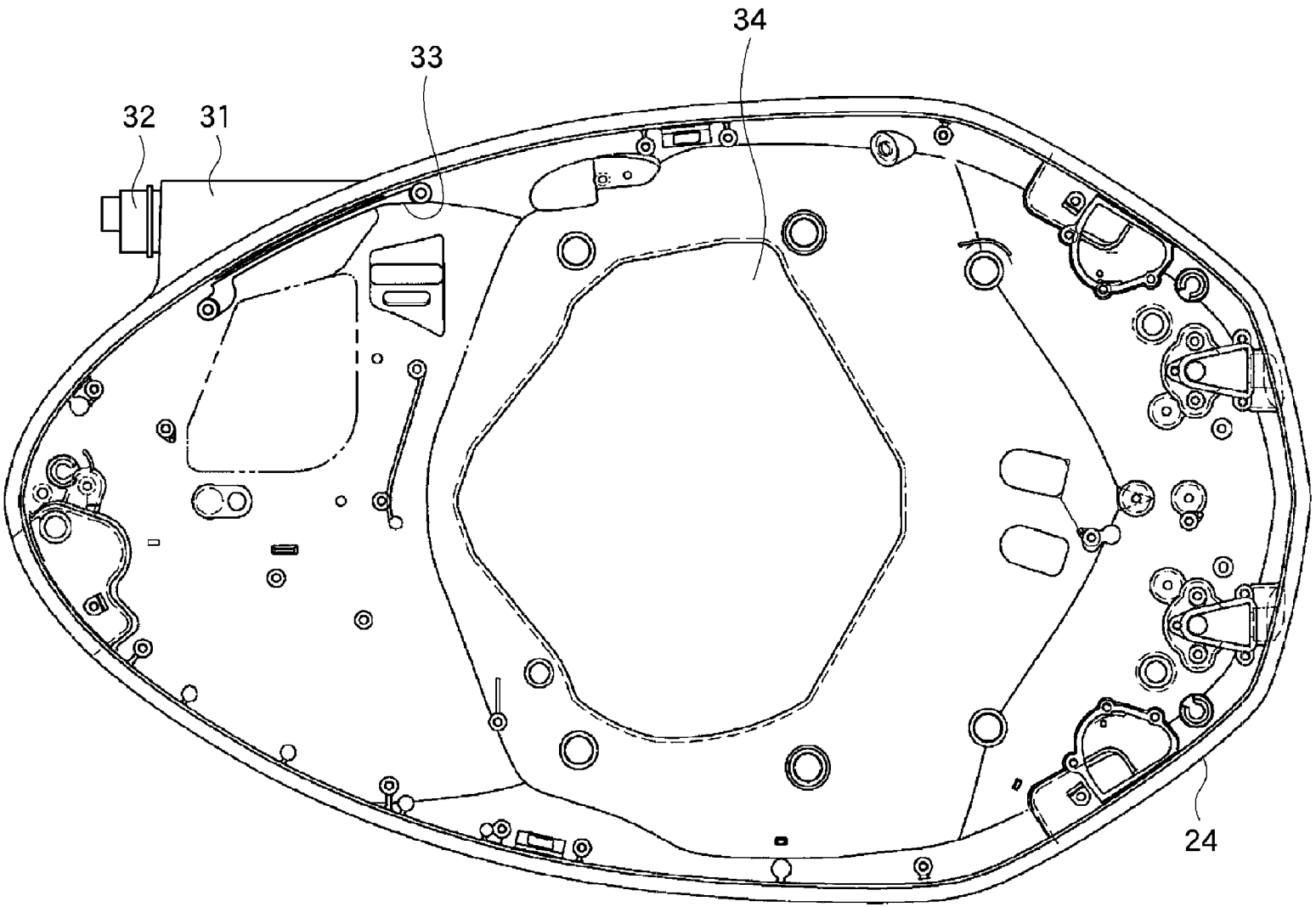
FIG. 3 is a plan view of the bottom cowling shown in FIG. 1 with a rubber grommet and a cover member attached thereto.

FIG. 3 is a plan view of the bottom cowling 24 in which a rubber grommet 32 is inserted from the outside into the opening of the port section 31, while a cover member 33 preferably having a continuous annular shape is attached to the internal end of the port section 31.

Figure 4:
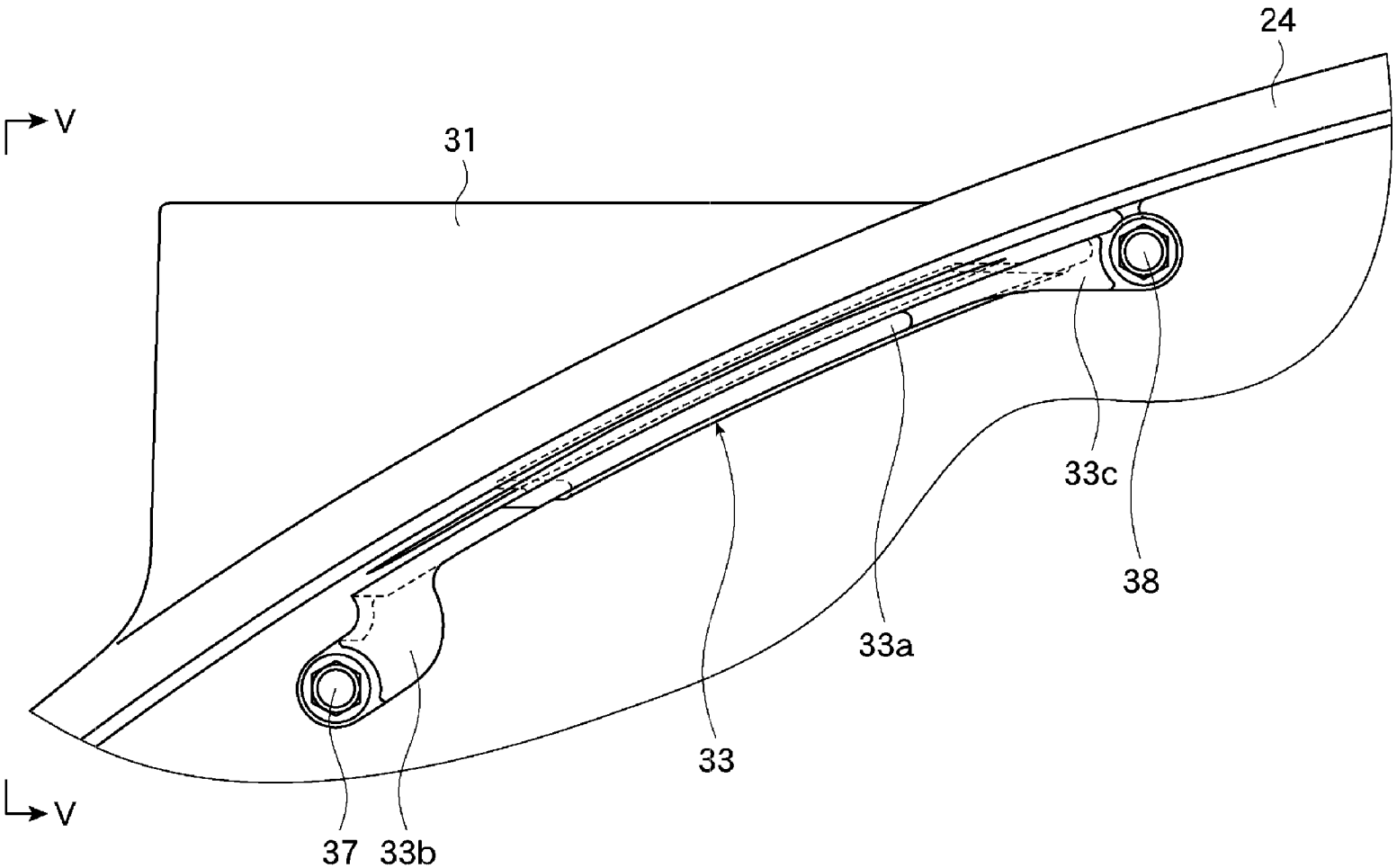
FIG. 4 is an enlarged plan view of the port section of the bottom cowling shown in FIG. 1.

FIG. 4 is an enlarged plan view showing the port section 31 of the bottom cowling 24. As shown in FIG. 2, the cover member 33 is fastened to mounting support rods 35, 36 by bolts 37, 38, with the mounting support rods 35, 36 extending upward from the inner base surface of the bottom cowling 24.

Figure 5:
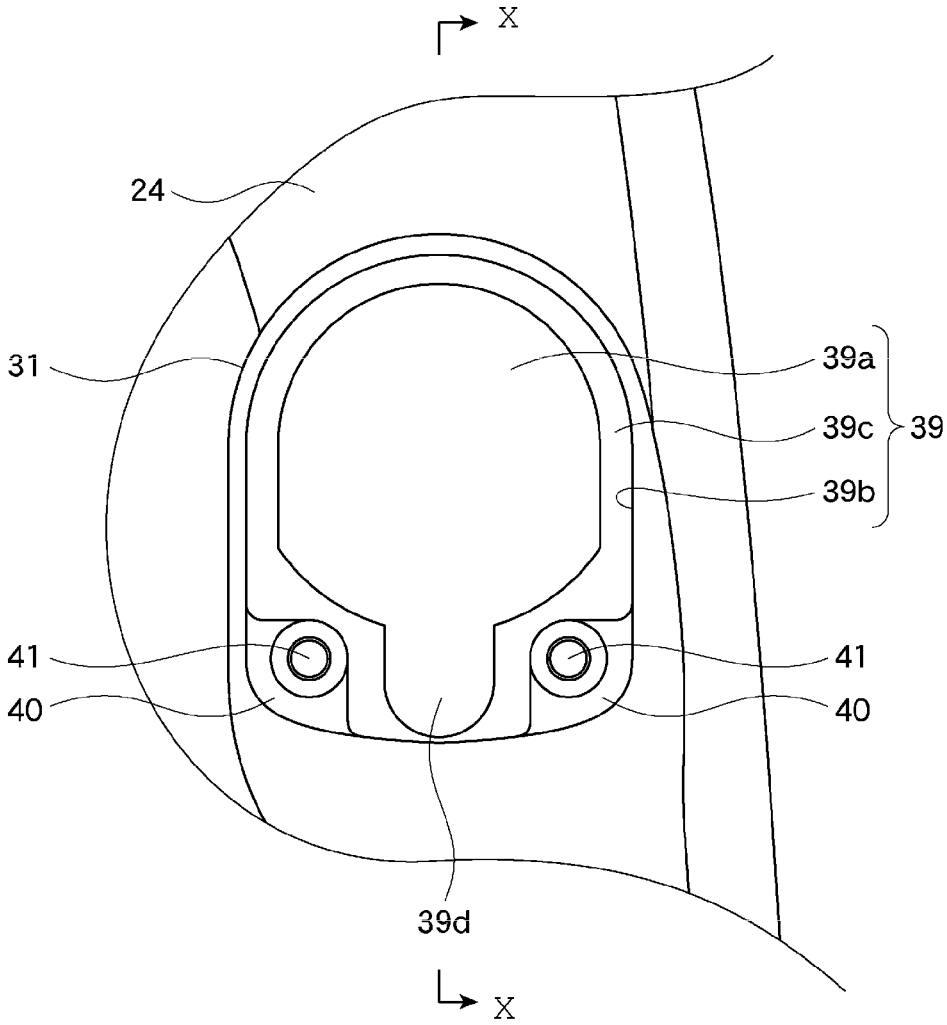
FIG. 5 is a front view of the port section, obtained by rotating the V-V view in FIG. 4 clockwise by 90 degrees.

FIG. 5 is a front view of the port section 31, obtained by rotating the view obtained from V-V view in FIG. 4 clockwise by 90 degrees.

The pass-through hole 39 of the port section 31 includes an insertion opening and an inner cylinder wall extending from the insertion opening to the inside of the engine hood. The pass-through hole 39 also includes an inner peripheral step that extends around the internal cylinder wall.

Specifically, the pass-through hole 39 includes a smaller diameter hole 39*a* in an inner portion, a larger diameter hole 39*b* in the outer portion, and a step end surface (a step on the inner periphery for sealing) 39*c* provided at the boundary between the smaller diameter hole 39*a* and the larger diameter hole 39*b*. The smaller diameter hole 39*a* includes a passage 39*d* in its lower central portion to guide a single cable. In the larger diameter hole 39*b*, seats 40, 40 are provided on both sides of the step end surface 39*c* extending toward the right and left of the passage 39*d*. Screw holes 41, 41 are provided in the seats 40, 40.

Figure 6:
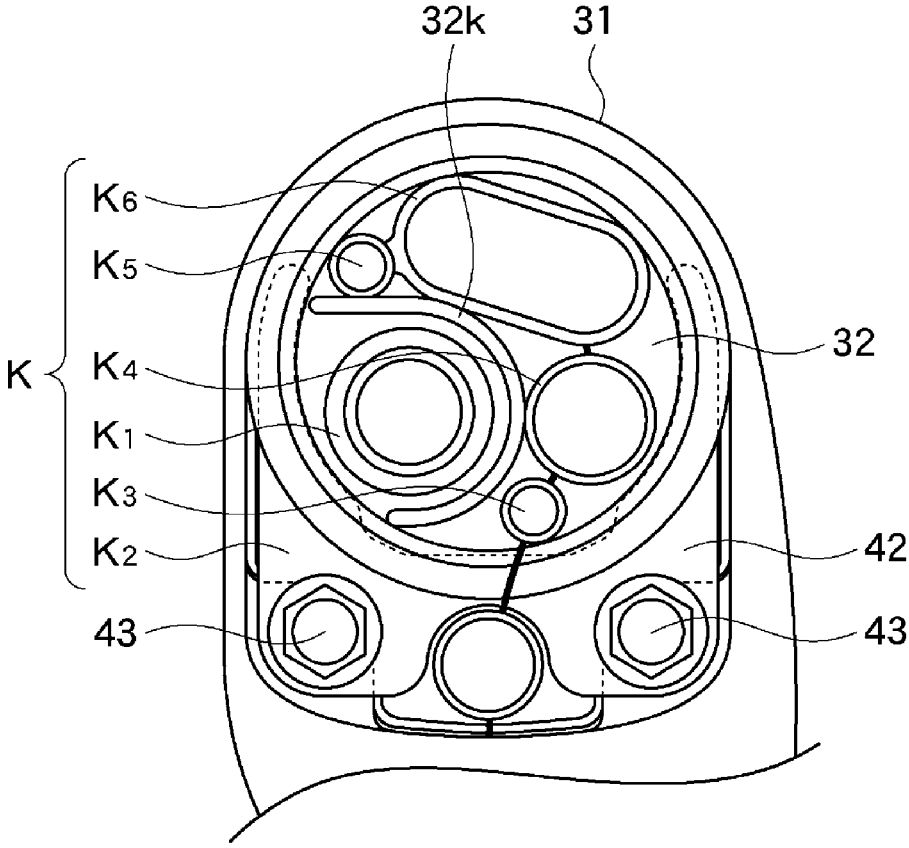
FIG. 6 is a front view of a pass-through hole in the port section as the cables are inserted into the through hole, and the through hole is water-sealed by a rubber grommet.
Figure 7:
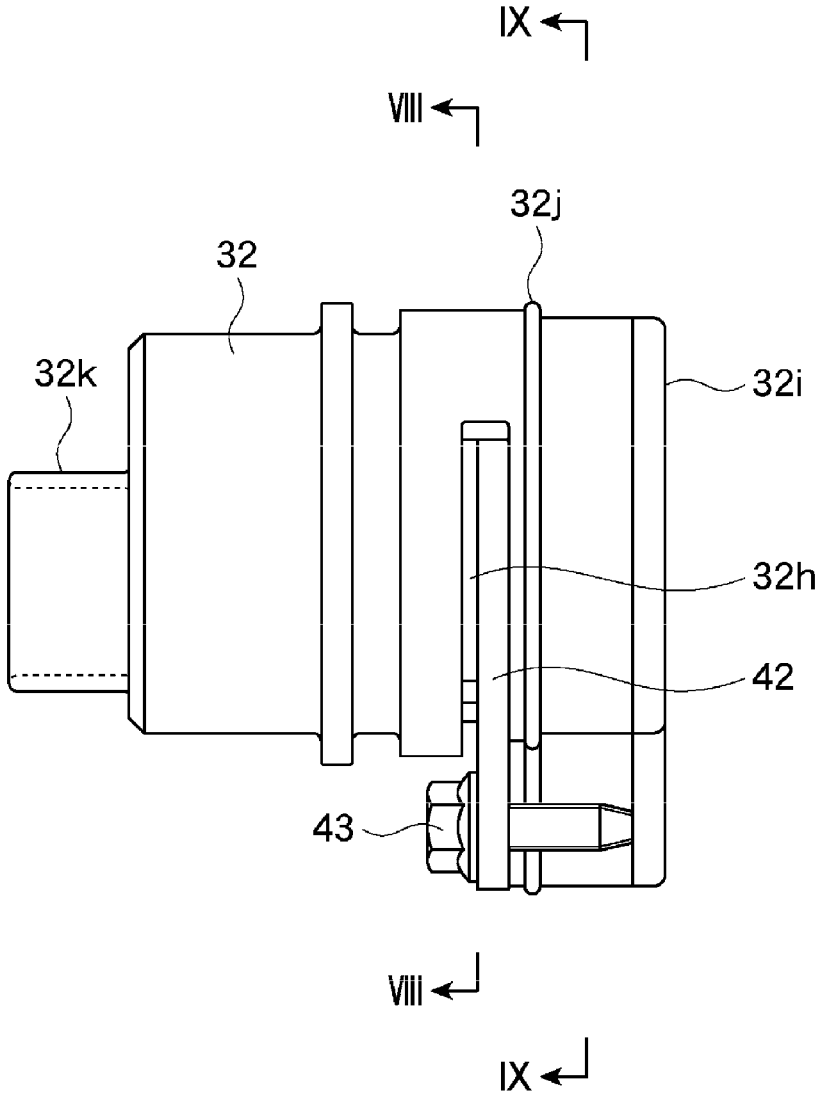
FIG. 7 is a side view of the rubber grommet.
Figure 8:
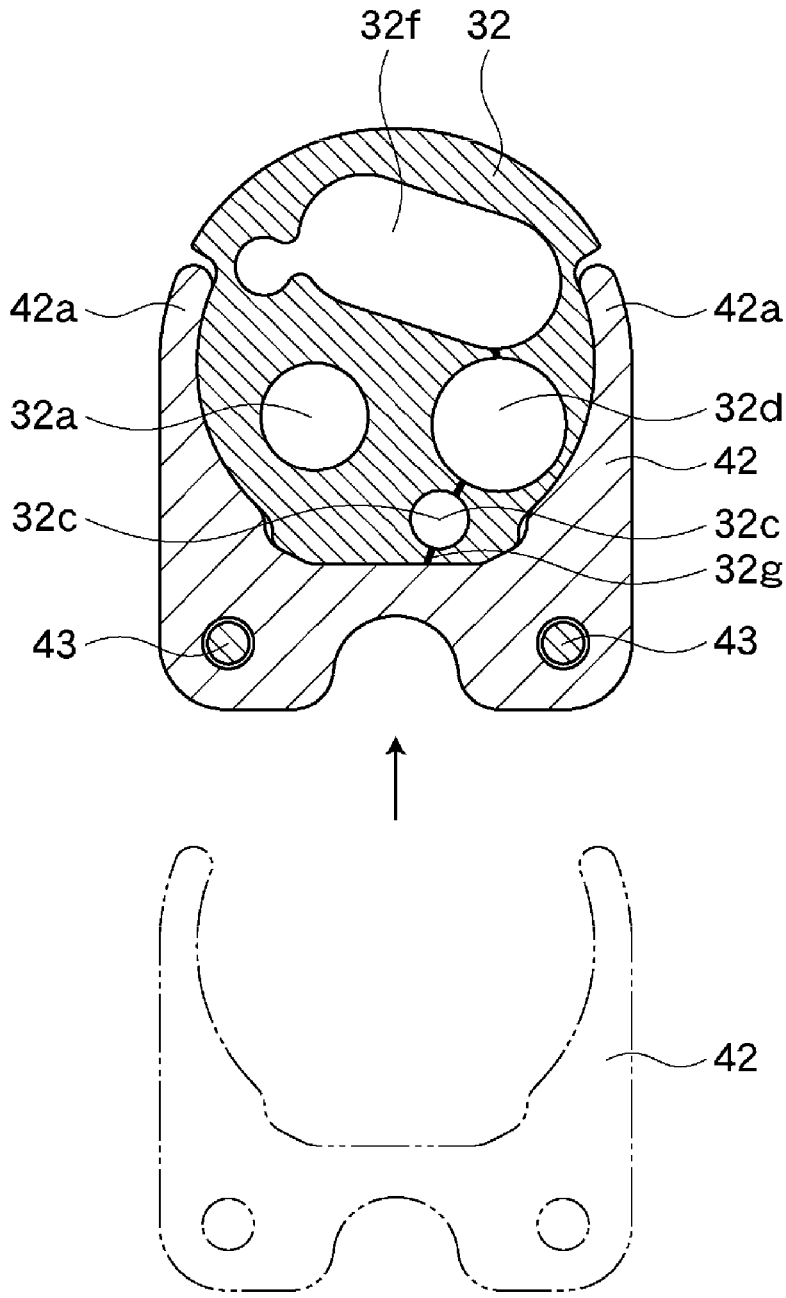
FIG. 8 is a cross-sectional view taken at the section VIII-VIII in FIG. 7 and viewed in the direction of an arrow.
Figure 9:
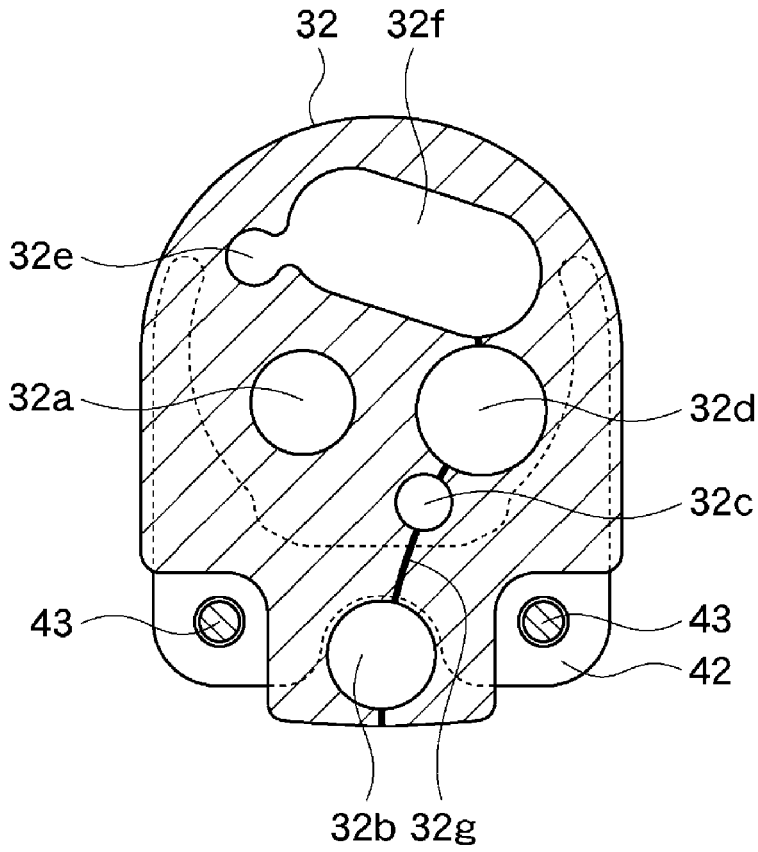
FIG. 9 is a cross-sectional view taken at the section IX-IX in FIG. 7 and viewed in the direction of an arrow.

FIG. 6 is a front view of the port section 31 in which the cables K (a fuel hose K1, a hose K2, a wiring K3, a wiring K4, a hose K5, and a wiring (battery cable) K6) are inserted through the pass-through hole of the port section 31, and the pass-through hole is water-sealed by the rubber grommet 32. FIG. 7 is a side view of the rubber grommet 32. FIG. 8 is a cross-sectional view of the rubber grommet 32 cut in the middle, taken along VIII-VIII in FIG. 7 and viewed in the direction of an arrow. Additionally, FIG. 9 is a cross-sectional view of the rubber grommet 32 cut in the middle, taken along IX-IX in FIG. 7 and viewed in the direction of an arrow.

The rubber grommet 32 is fitted into the pass-through hole 39 in FIG. 5 so that the right edge of the grommet 32 in FIG. 7 is inserted first as a front edge. As shown in FIGS. 8 and 9, the rubber grommet 32 has through-holes 32*a*, 32*b*, 32*c*, 32*d*, 32*e*, and 32*f* through which the fuel hose K1, the hose K2, the wiring K3, the wiring K4, the hose K5, and the wiring K6 shown in FIG. 6 are inserted. A slit 32*g* is provided from the bottom surface of the rubber grommet 32. The slit 32*g* communicates the through-holes 32*b*, 32*c*, 32*d* and 32*f* in this order. The rubber grommet 32 can open up widely by the slit 32*g* to enable insertion of the hose K2, the wiring K3, the wiring K4, the hose K5, and the wiring K6 in the through-holes 32*b*, 23*c*, 32*d*, 32*e*, and 32*f*, to provide the water-seal around these cables. The rubber grommet 32 includes a protrusion 32*k* on its outer end surface, which is has a semi-cylindrical shape to encircle the through-hole 32*a*. Since a joint member (made of metal) of the fuel hose K1 that is inserted into the through-hole 32*a* is disposed very close to the rubber grommet 32, the protrusion 33*k* is provided to prevent the possible interference of the joint member with the other cables.

The rubber grommet 32 has a slot 32*h* in the outer surface in a middle section slight towards the right end as shown in FIG. 7. A retainer plate 42 as shown in FIG. 9 fits into the slot 32*h*. The retainer plate 42, including a pair or arms 42*a*, 42*a* extending to form a concave opening, is fit into the slot 32*h* on the rubber grommet 32 from below. The pair of arms 42*a*, 42*a* wrap around the outer surface of the rubber grommet 32 in a middle portion along the axis of the through-holes. In this manner, the rubber grommet 32 is wrapped around by the retainer plate 42 to prevent the slit 32*g* from opening up.

Figure 10:
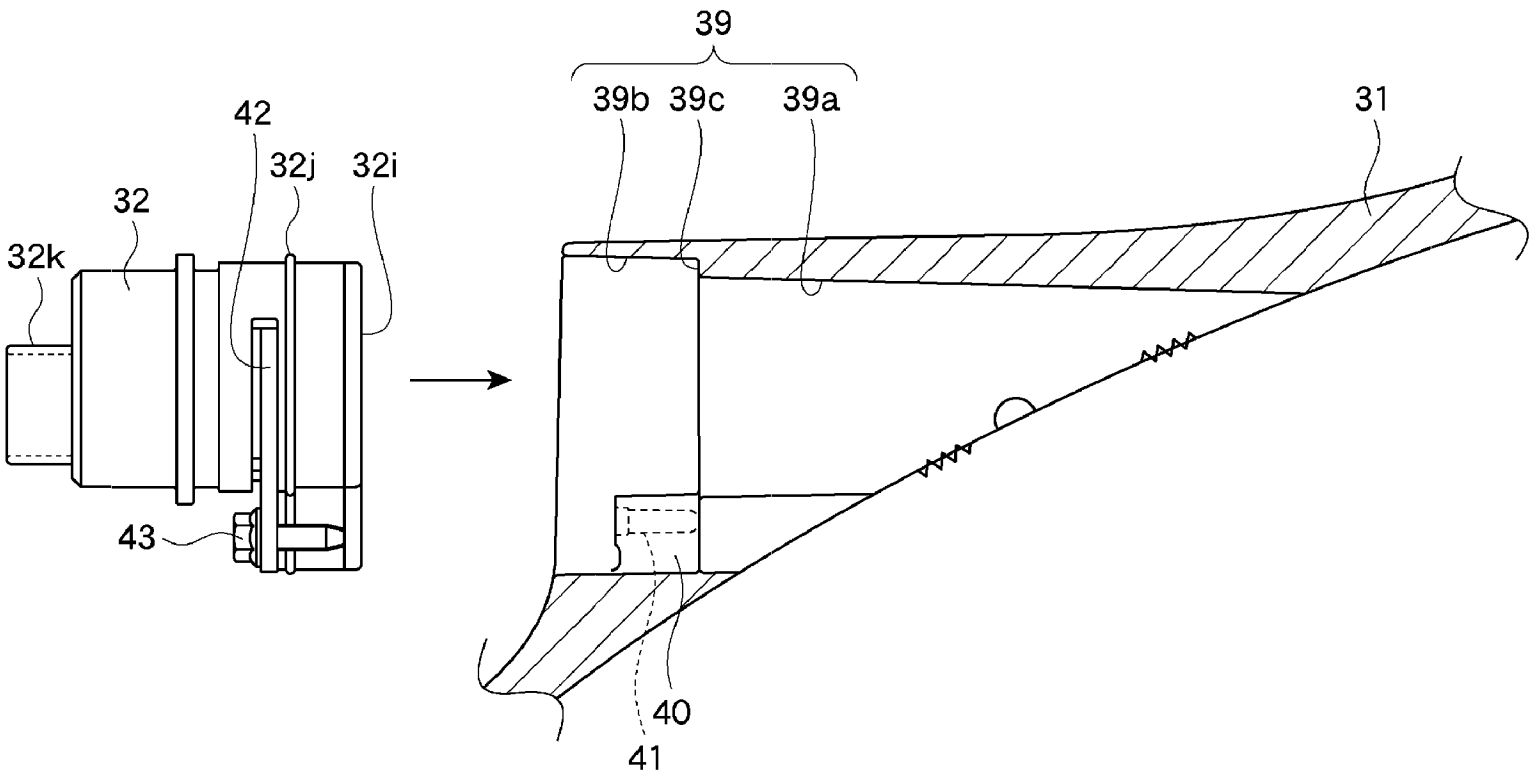
FIG. 10 is a cross-sectional view taken along line X-X of the pass-through hole in the port section in FIG. 5, in which a retainer plate is fitted to the rubber grommet, and the rubber grommet is not yet fitted into the larger diameter portion of the pass-through hole in the port section.
Figure 11:
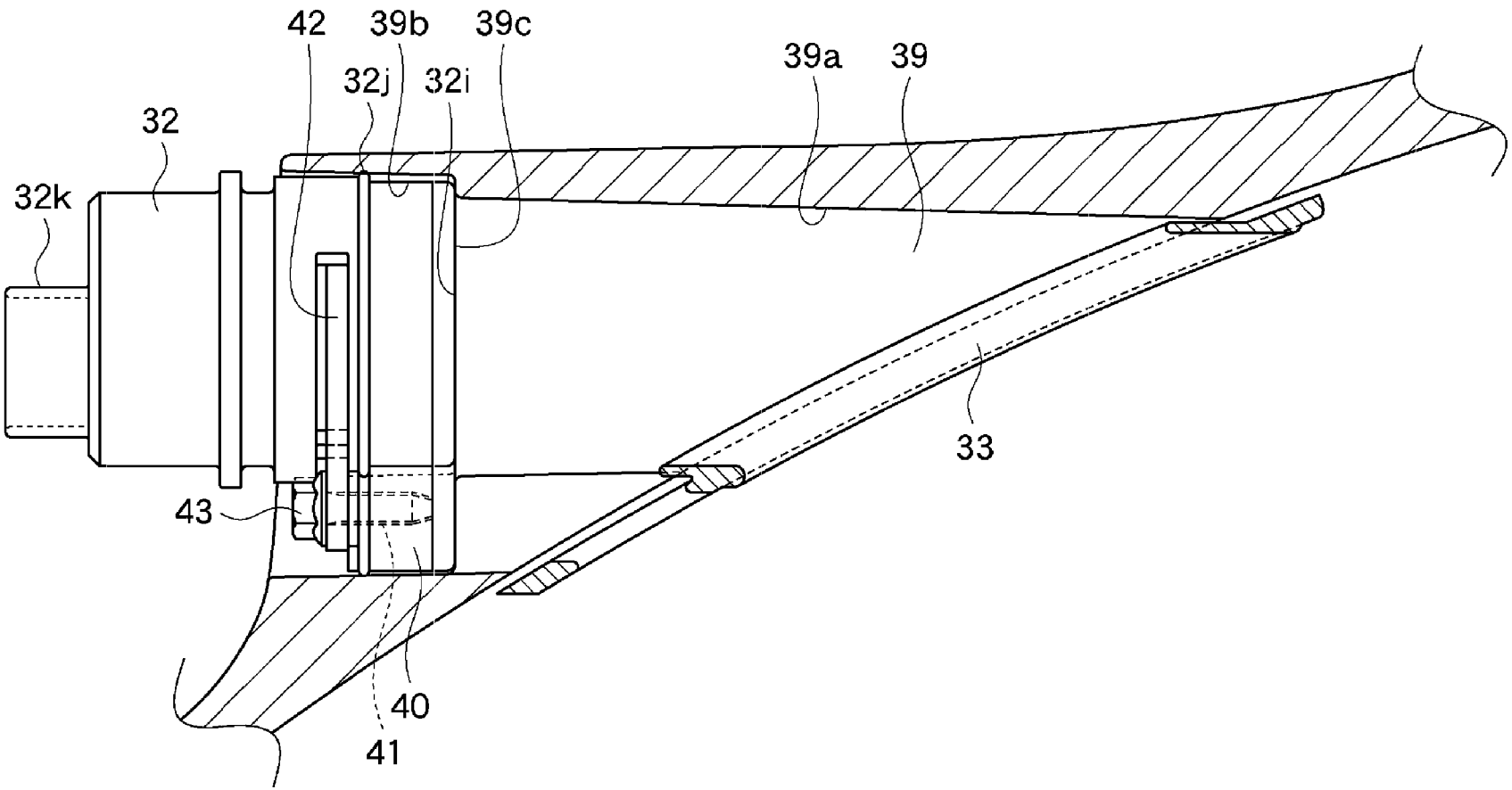
FIG. 11 is a cross-sectional view of the pass-through hole in the port section, in which a retainer plate is fitted to the rubber grommet, and the rubber grommet is fitted into the larger diameter portion of the pass-through hole in the port section.

To install the rubber grommet 32, first the cables K as shown in FIGS. 1 and 6 are inserted through the rubber grommet 32. Then, the retainer plate 42 is wrapped around the rubber grommet 32 to prevent the slit 32*g* from opening up, and subsequently the rubber grommet 32 is fit into the larger diameter hole 39*b* of the pass-through hole 39 in the port section 31 as shown in FIGS. 10 and 11. A pair of bolt holes are provided in the retainer plate 42, and bolts 43 are mounted in each of the bolt holes. The rubber grommet 32 is fastened in the larger diameter hole 39*b* of the pass-through hole 39 by tightening the bolts 43 to the screw holes 41, 41, in the seats 40, 40, and is configured to provide water-sealing by an inserting front edge (abutted sealing section) 32*i* being tightly in contact with the step end surface 39*c* that is provided in the pass-through hole 39 of the port section 31. In addition, the rubber grommet 32 provides water-sealing by one or more protruding strip sealing areas (only one protruding strip is shown in the illustration) 32*j* provided in a middle portion of the outer surface of the rubber grommet 32 being tightly in contact with the larger diameter hole 39*a* in the pass-through hole 39 of the port section 31.

With the configuration described above, the retainer plate 42 is fastened to the seats 40, 40 and pressed toward the inside of the engine hood by the mounting bolts 43 inside the port section 31. Consequently, the rubber grommet 32 provides water-sealing as it is fixed within the pass-through hole by the retainer plate 42 with the rubber grommet periphery including the opening ends of the slit 32*g* being shrouded by the retainer plate 42. At the same time, the rubber grommet 32 provides water-sealing by filling the gap around the cables K within the pass-through hole. Although the inserting front edge 32*i* of the rubber grommet 32 provides the abutted sealing section in this preferred embodiment, a step that defines the abutted sealing section can be provided on the rubber grommet periphery in the middle portion of the portion inward from the location of the retainer plate 42, and the step end surface (a step on the inner periphery for sealing) 39*c* may provided at the location corresponding to the abutted sealing section.

Figure 12A:
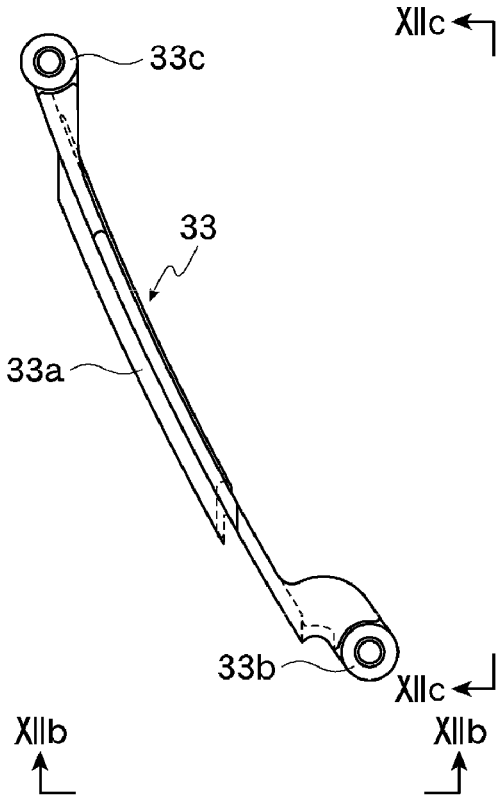
FIG. 12A is a plan view of a cover member.
Figure 12C:
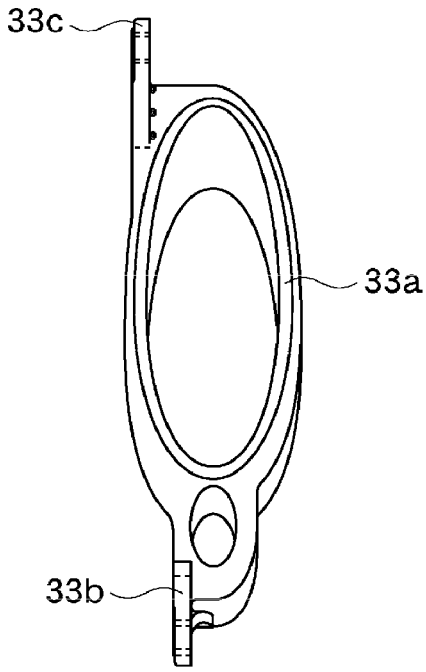
FIG. 12C is a view along a line XIIc-XIIc viewed in the direction of arrows shown in FIG. 12A.
Figure 12B:
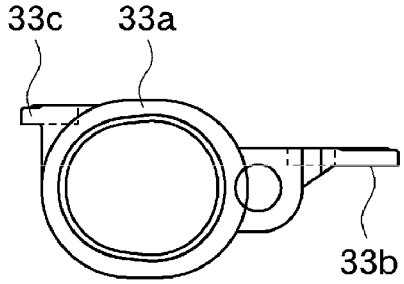
FIG. 12B is a view along a line XIIb-XIIb, viewed in the direction of arrows shown in FIG. 12A.

FIGS. 12A to 12C show the detailed configuration of the cover member 33 as shown in FIG. 4, mounted on the inner surface of the bottom cowling 24 to be compatible with the port section 31. In this preferred embodiment, the port section 31 is provided integrally on the wall of the bottom cowling 24 molded in an approximately oval shape, to the right and close to the boat hull, where the bottom cowling wall extends at a steep angle relative to the fore and aft direction of the boat hull. Thus, as shown in FIG. 3, the mounting structure for the cables of the boat propulsion unit includes the cover member 33 arranged to protect the cables K from sharp edges and flashing at the corners of the opening periphery on the inside of the bottom cowling 24 of the port section 31.

The cover member 33 preferably has a cross-sectional shape that overlaps the inner surface of the bottom cowling 24 and the pass-through hole 39 of the port section 31. At the same time, the cover member 33 has a continuous annular shape.

As shown in FIG. 12, the cover member 33 includes a pair of mounting portions 33*b*, 33*c* extending to both sides from the upper end of the continuous annular portion 33*a*. The cover member 33 is fastened to the bottom cowling 24 by inserting mounting bolts 37, 38 in the bolt holes provided on each of the mounting portions 33*b*, 33*c* and screwing the mounting bolts 37, 38 into the cover member mounting portion rising from the bottom cowling 24.

In this manner, the corners of the opening periphery on the inside of the bottom cowling 24 of the port section 31 are enclosed by the cover member 33. As a result, the cover member 33 protects the cables K against the sharp flashing that may be generated at the corners of the opening periphery during the molding process of the bottom cowling 24. The cover member 33 also protects the cables K from the sharp edges in case the cables K come in contact with the sharp edge at the corners of the opening periphery, when the sharp edge is created by providing the through hole 39 of the port section 31 at a sharp angle relative to the bottom cowling 24.

According to the preferred embodiment described above, the port section 31 for guiding the cables K is not separated from the bottom cowling, and instead, is integrally provided therewith. As a result, the cover element defining the engine hood for covering the engine 27 (the cover element is the bottom cowling 24 in this preferred embodiment) can be easily manufactured, and no sealing is required for the port section 31. In addition, installation of the cables K in the mounting structure is facilitated because the rubber grommet 32 can be inserted into the pass-through hole 39 from the outside. Further, the pass-through hole 39 can be effectively water-sealed by the rubber grommet 32, since the abutted sealing section 32*i* is pressed against the step 39*c* on the inner periphery for sealing.

Also according to the preferred embodiment described above, the cables K are inserted in the through-holes of the rubber grommet 32 by opening up the slit 32*g*, and then the rubber grommet 32 is shrouded by the retainer plate 42 before it is inserted into the pass-through hole 39 and fastened therein in a pressurized condition. This makes it easier to insert the rubber grommet 32 into the pass-through hole 39, because the retainer plate 42 prevents the slit 32*g* from opening up as the retaining plate 42 is wrapped around the rubber grommet 32, and no step or gap will be present at the slit 32*g* of the rubber grommet 32 during the insertion as the rubber grommet 32 is inserted together with the retainer plate 42.

In addition, according to the preferred embodiment described above, the pair of arms 42*a*, 42*a* of the retainer plate 42 wraps around the slot 32*h* of the rubber grommet 32 to press it toward the inner portion of the pass-through hole 39 in the port section 31, resulting in a firmly fixed rubber grommet 32. Thus, reliable water-sealing for the pass-through hole 39 of the port section 31 is provided by the rubber grommet 32, since the sealing area of the rubber grommet 32 is pressed tightly against the sealing area of the pass-through hole of the port section 31.

Further, according to the preferred embodiment described above, the rubber grommet 32 provides water-sealing at two or more locations in the pass-through hole 39 of the port section 31, resulting in further improved water-sealing quality.

Still further, according to the preferred embodiment described above, the corners of the opening periphery on the inside of the bottom cowling 24 of the port section 31 are enclosed by the cover member 33 having a continuous annular shape. Thus, the cover member 33 protects the cables K against the flashing that may be generated at the corners of the opening periphery during the molding process of the bottom cowling 24. The cover member 33 also protects the cables K from the sharp edge when the cables K come in contact with the sharp edge at the corners of the opening periphery, in view of the fact that the sharp edge is inevitably created by providing the pass-through hole 39 of the port section 31 at a sharp angle relative to the bottom cowling 24.

In the case of the preferred embodiment described above, the outboard motor is used as the "boat propulsion unit," but this is not limited to the outboard motor. Needless to say, the "boat propulsion unit" can be a stern drive unit, or any other type of boat propulsion unit.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A mounting structure for cables of a boat propulsion unit, the mounting structure comprising:

a pass-through hole located close to a boat hull in a cover element of an engine hood covering an engine; and a rubber grommet having through-holes through which the cables extending from the boat hull to an inside portion of the engine hood are inserted, the rubber grommet being disposed in the pass-through hole; wherein the pass-through hole is integral with the cover element around an entire periphery of the pass-through hole;

the pass-through hole includes an insertion opening, an inner cylinder wall extending from the insertion opening to the inside portion of the engine hood, and an inner peripheral step extending around and inward from the inner cylinder wall; and an abutted sealing section is provided on the rubber grommet that abuts the inner peripheral step when the rubber grommet is inserted into the insertion opening.

2. The mounting structure for the cables for the boat propulsion unit according to claim 1, wherein the rubber grommet includes a slit provided therein, the slit having an external end extending to a portion of a periphery of the rubber grommet;

the cables are inserted into the through-holes of the rubber grommet by opening up the slit provided in the rubber grommet; and a retainer plate is provided around a periphery of the rubber grommet including the portion at which the external end of the slit extends, such that the rubber grommet is fixed by the retainer plate so as to pressurize the rubber grommet and prevent the slit from opening up.

3. The mounting structure for the cables for the boat propulsion unit according to claim 2, wherein the retainer plate includes a pair of arms extending so as to form a concave opening therebetween;

the pair of arms wraps around an outer surface of the rubber grommet at a middle section thereof along an axis of the through-holes;

the rubber grommet is arranged such that the at least one external end of the slit is disposed between the pair of arms of the retainer plate; and the rubber grommet includes a slot in the middle section in which the pair of arms on the retainer plate is inserted.

4. The mounting structure for the cables for the boat propulsion unit according to claim 1, wherein the rubber grommet includes an inserting front edge and at least one protruding strip sealing area provided at a middle section of an outer surface thereof; and the rubber grommet provides water-sealing by the inserting front edge of the rubber grommet being tightly in contact with the inner peripheral step, and by the at least one protruding strip sealing area being tightly in contact with the inner cylinder wall of the pass-through hole.

5. The mounting structure for the cables of the boat propulsion unit according to claim 1, wherein a cover member having a continuous annular shape is provided at corners of an opening periphery on the inside of the cover element to which the pass-through hole is provided, the cover member being arranged to cover the corners of the opening periphery.

6. The mounting structure for the cables of the boat propulsion unit according to claim 5, wherein the cover element includes at least one mounting support rod, and the cover member is attached to the cover element via at least one bolt that is threadedly attached to the at least one mounting support rod.

7. The mounting structure for the cables of the boat propulsion unit according to claim 1, wherein the rubber grommet includes a protrusion on an outer end surface opposite to the abutted sealing section of the rubber grommet, the protrusion being arranged to prevent interference between a joint member of one of the cables and the other cables.

8. The mounting structure for the cables of the boat propulsion unit according to claim 2, wherein the retainer plate includes at least one bolt hole arranged to receive a bolt so as to attach the retainer plate and the rubber grommet to the cover element.

9. The mounting structure for the cables of the boat propulsion unit according to claim 2, wherein the slit of the rubber grommet extends through a plurality of the through-holes.

10. A boat comprising:

a boat hull;

a boat propulsion unit attached to a stern portion of the boat hull; wherein the boat propulsion unit includes the mounting structure for cables recited in claim 1.

11. A mounting structure for cables of a boat propulsion unit, comprising:

a pass-through hole in a cowling of an engine hood covering an engine attached to a stern portion of a boat hull; and a rubber grommet having through-holes through which cables extending from the boat hull to an inside portion of the engine hood are inserted, the rubber grommet being disposed in the pass-through hole; wherein the pass-through hole is integrally molded with the cowling;

the pass-through hole includes an insertion opening having a smaller diameter hole in an inner portion, a larger diameter hole in an outer portion, and a step end surface provided at a boundary between the smaller diameter hole and the larger diameter hole; and an abutted sealing section is provided on the rubber grommet that is arranged to abut the step end surface when the rubber grommet is inserted in the insertion opening.

12. The mounting structure for the cables for the boat propulsion unit according to claim 11, wherein the rubber grommet includes a slit provided therein, the slit having an external end extending to a portion of a periphery of the rubber grommet;

the cables are inserted into the through-holes of the rubber grommet by opening up the slit provided in the rubber grommet; and a retainer plate is provided around a periphery of the rubber grommet including the portion at which the external end of the slit extends, such that the rubber grommet is fixed by the retainer plate so as to pressurize the rubber grommet and prevent the slit from opening up.

13. The mounting structure for the cables for the boat propulsion unit according to claim 12, wherein the retainer plate includes a pair of arms extending so as to form a concave opening therebetween;

the pair of arms wraps around an outer surface of the rubber grommet at a middle section thereof along an axis of the through-holes;

the rubber grommet is arranged such that the external end of the slit is disposed between the pair of arms of the retainer plate; and the rubber grommet includes a slot in the middle section thereof into which the pair of arms on the retainer plate is inserted.

14. The mounting structure for the cables for the boat propulsion unit according to claim 11, wherein the rubber grommet includes an inserting front edge and at least one protruding strip sealing area provided at a middle section of an outer surface thereof; and the rubber grommet provides water-sealing by the inserting front edge of the rubber grommet being tightly in contact with the step end surface, and by the at least one protruding strip sealing area being tightly in contact with the smaller diameter hole of the pass-through hole.

15. The mounting structure for the cables of the boat propulsion unit according to claim 11, wherein a cover member having a continuous annular shape is provided at corners of an opening periphery on the inside of the cowling to which the pass-through hole is provided, the cover member being arranged to cover the corners of the opening periphery.

16. The mounting structure for the cables of the boat propulsion unit according to claim 15, wherein the cowling includes at least one mounting support rod, and the cover member is attached to the cowling via at least one bolt that is threadedly attached to the at least one mounting support rod.

17. The mounting structure for the cables of the boat propulsion unit according to claim 11, wherein the rubber grommet includes a protrusion on an outer end surface opposite to the abutted sealing section of the rubber grommet, the protrusion being arranged to prevent interference between a joint member of one of the cables and the other cables.

18. The mounting structure for the cables of the boat propulsion unit according to claim 12, wherein the retainer plate includes at least one bolt hole arranged to receive a bolt so as to attach the retainer plate and the rubber grommet to the cowling.

19. The mounting structure for the cables of the boat propulsion unit according to claim 12, wherein the slit of the rubber grommet extends through a plurality of the through-holes.

20. A boat comprising:

a boat hull;

a boat propulsion unit attached to a stern portion of the boat hull; wherein the boat propulsion unit includes the mounting structure for cables recited in claim 11.

* * * * *